US009418596B2

(12) United States Patent
Yu

(10) Patent No.: US 9,418,596 B2
(45) Date of Patent: Aug. 16, 2016

(54) ORGANIC LIGHT EMITTING DISPLAY AND METHOD FOR DRIVING THE SAME

(71) Applicant: LG DISPLAY CO., LTD., Seoul (KR)

(72) Inventor: Sangho Yu, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 31 days.

(21) Appl. No.: 13/942,214

(22) Filed: Jul. 15, 2013

(65) Prior Publication Data

US 2014/0085290 A1 Mar. 27, 2014

(30) Foreign Application Priority Data

Sep. 25, 2012 (KR) ..... 10-2012-0106564

(51) Int. Cl.
*G09G 3/30* (2006.01)
*G09G 3/32* (2016.01)
*G09G 3/00* (2006.01)

(52) U.S. Cl.
CPC ..... *G09G 3/3291* (2013.01); *G09G 3/006* (2013.01); *G09G 3/3208* (2013.01); *G09G 3/3233* (2013.01); *G09G 2330/027* (2013.01); *G09G 2330/045* (2013.01)

(58) Field of Classification Search
CPC ... G09G 3/3291; G09G 3/34; H05B 37/0227; H05B 33/08
USPC ..... 345/76, 214; 323/282
See application file for complete search history.

(56) References Cited

U.S. PATENT DOCUMENTS

2007/0046587 A1* 3/2007 Takahara ..... 345/76
2008/0130822 A1* 6/2008 Hsu et al. ..... 377/79
2010/0177126 A1* 7/2010 Inoue et al. ..... 345/690
2011/0069059 A1* 3/2011 Lee et al. ..... 345/212
2012/0062271 A1* 3/2012 Bawolek et al. ..... 324/762.09
2013/0314064 A1* 11/2013 Theiler ..... G09G 3/3406 323/282

FOREIGN PATENT DOCUMENTS

DE WO/2012007995 * 6/2012 ..... G09G 3/34

* cited by examiner

*Primary Examiner* — Calvin C Ma
(74) *Attorney, Agent, or Firm* — Birch, Stewart, Kolasch & Birch, LLP

(57) ABSTRACT

An organic light emitting display and method for driving the same are discussed. The organic light emitting display according to an embodiment includes a panel, drivers, and a short circuit detector. The short circuit detector forms a closed loop with a signal line, transmits input pulses through one end of the signal line and receives output pulses fed back through the other end of the signal line compares the input pulses and the output pulses.

16 Claims, 10 Drawing Sheets

ORGANIC LIGHT EMITTING DISPLAY AND METHOD FOR DRIVING THE SAME

This application claims the benefit of Korean Patent Application No. 10-2012-0106564 filed on Sep. 25, 2012, which is incorporated herein by reference for all purposes as if fully set forth herein.

BACKGROUND OF THE INVENTION

1. Field of the Invention

This document relates to an organic light emitting display and a method for driving the same.

2. Description of the Related Art

An organic light emitting element used for an organic light emitting display is a self-emission element in which a light emitting layer is formed between two electrodes disposed on a substrate. The organic light emitting display is divided into a top-emission type, a bottom-emission type, and a dual-emission type according to a light emission direction. The organic light emitting display is further divided into a passive matrix type and an active matrix type according to a driving method.

A subpixel disposed in an organic light emitting display panel comprises a transistor part including a switching transistor, a driving transistor, and a capacitor and an organic light emitting diode including a lower electrode connected to the driving transistor included in the transistor part, an organic light emitting layer, and an upper electrode.

The luminance of the organic light emitting display panel depends on the amount of current flowing through the organic light emitting diode. As the organic light emitting display panel requires high current compared to a liquid crystal display panel, overcurrent flows through the element included in the subpixel when a short circuit occurs. Short circuit can occur in a variety of locations and parts during a manufacturing process (or module process), due to a variety of causes, including internal structural causes such as particles drawn into the organic light emitting display panel, cracks, misalignment of pads, and narrow layout of lines, and external causes such as static electricity.

Meanwhile, when a short circuit occurs, overcurrent flows into the panel, and this generates high-temperature heat and burns the elements included in the subpixels of the panel, thus increasing the possibility of a fire. Hence, a solution to address this is needed.

SUMMARY OF THE INVENTION

Embodiments of the present invention have been made in an effort to provide an organic light emitting display including: a panel; drivers to drive the panel; and a short circuit detector that forms a closed loop with a signal line of the panel, transmits input pulses through one end of the signal line and receives output pulses fed back through the other end of the signal line, and compares the input pulses and the output pulses.

In another aspect, an embodiment of present invention provides a method for driving an organic light emitting display, the method including: displaying an image on a panel; generating input pulses to be supplied to a signal line of the panel; transmitting the input pulses through one end of the signal line and receiving output pulses fed back through the other end of the signal line; and comparing the input pulses and the output pulses.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings.

Hereinafter, a concrete example embodiment of the present invention will be described with reference to the accompanying drawings.

Figure 1:
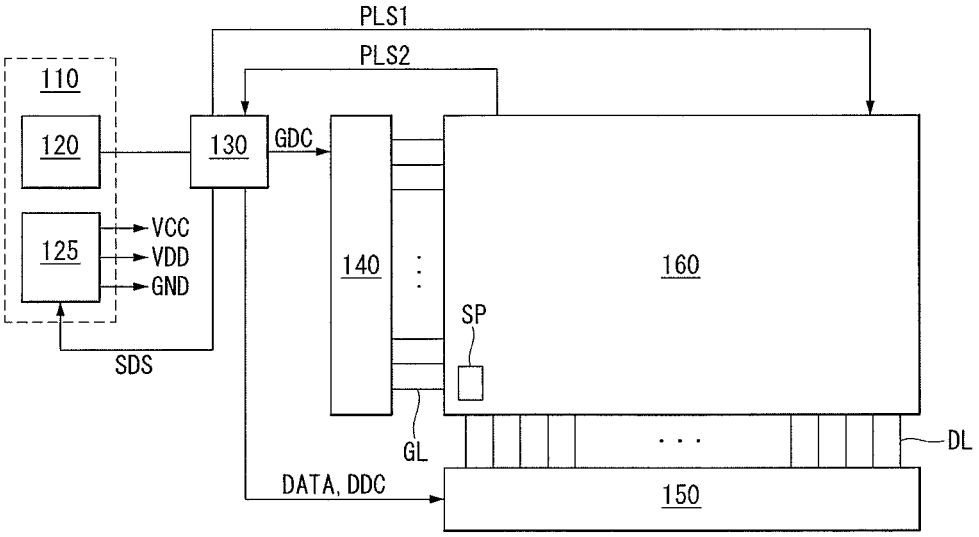
FIG. 1 is a schematic view of an organic light emitting display in accordance with an embodiment of the present invention.
Figure 2:
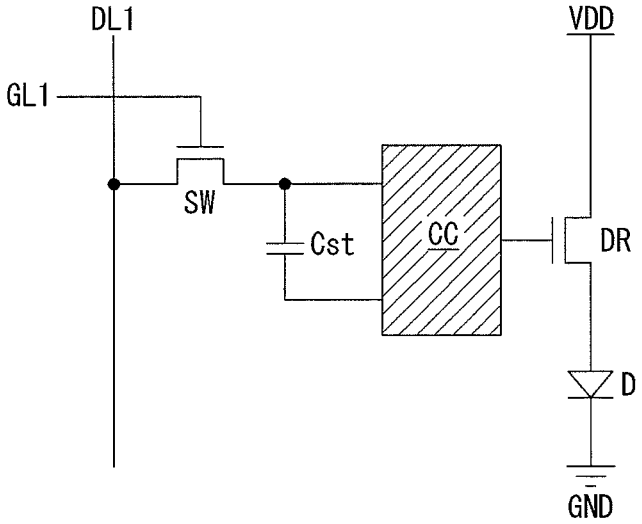
FIG. 2 is an illustration of a circuit configuration of a subpixel in accordance an embodiment of the present invention.

FIG. 1 is a schematic view of an organic light emitting display in accordance with an embodiment of the present invention. FIG. 2 is an illustration of the circuit configuration of a subpixel in accordance with an embodiment of the present invention.

As shown in FIGS. 1 and 2, an organic light emitting display in accordance with the present invention comprises an image processing part 120, a power supply part 125, a timing controller 130, a data driver 150, a scan driver 140, and a panel 160.

The image processing part 120 supplies a vertical synchronization signal Vsync, a horizontal synchronization signal Hsync, a data enable signal DE, a clock signal CLK, and a data signal DATA to the timing controller 130. The image processing part 120 is formed on a system board 110.

The timing controller 130 controls operation timings of the data driver 150 and the scan driver 140 by using timing signals, such as the vertical synchronization signal Vsync, the horizontal synchronization signal Hsync, the data enable signal DE, the clock signal CLK, and the like, supplied from the image processing part 120. The timing controller 130 may determine a frame period by counting the data enable signal DE of one horizontal period, so that the vertical synchronous signal Vsync and the horizontal synchronous signal Hsync supplied from the outside may be omitted. Control signals generated by the timing controller 130 may comprise a gate timing control signal GDC for controlling an operational timing of the scan driver 140 and a data timing control signal DDC for controlling an operational timing of the data driver 150. The gate timing control signal GDC comprises a gate start pulse, a gate shift clock, a gate output enable signal, and the like. The data timing control signal DDC comprises a source start pulse, a source sampling clock, a source output enable signal, and the like.

In response to the gate timing control signal GDC supplied from the timing controller 130, the scan driver 140 sequentially generates scan signals while shifting the level of a gate driving voltage. The scan driver 140 supplies the scan signals through scan lines GL connected to the subpixels SP included in the panel 160.

In response to the data timing control signal DDC supplied from the timing controller 130, the data driver 150 samples a data signal DATA supplied from the timing controller 130 and latches the sampled signal to convert it into data of a parallel data system. The data driver 150 converts the data signal DATA into a gamma reference voltage. The data driver 150 supplies the data signal DATA through data lines DL connected to the subpixels SP included in the panel 160.

The panel 160 comprises subpixels SP disposed in a matrix form. The subpixels SP comprise red subpixels, green subpixels, and blue subpixels, and in some cases, may comprise white subpixels. In the panel 160 comprising white subpixels, the light emitting layer of each of the subpixels SP may emit white light but not red, green, and blue lights. In this instance, white emitted light is converted into red, green, and blue lights by RGB color filters.

The subpixels included in the panel 160 may be configured, for example, as shown in FIG. 2. A subpixel may comprise a switching transistor SW, a driving transistor DR, a capacitor Cst, a compensation circuit CC, and an organic light emitting diode D. The switching transistor SW is switched on to store a data signal supplied through a first data line DL1 as a data voltage in the capacitor Cst, in response to a scan signal supplied through a first scan line SL1. The driving transistor DR is operable to cause driving current to flow between a first power supply line VDD and a ground line GND in response to the data voltage stored in the capacitor Cst. The compensation circuit CC comprises at least one transistor and at least one capacitor. The compensation circuit CC may be configured in various ways, so detailed illustration and description thereof will be omitted. The organic light emitting diode D is operable to emit light in response to the driving current generated by the driving transistor DR.

A subpixel may have a 2T (Transistor) 1C (Capacitor) structure comprising a switching transistor SW, a driving transistor DR, a capacitor Cst, an organic light emitting diode D, or may have a 3T1C structure, a 4T1C structure, a 5T2C structure, and the like, further comprising a compensation circuit CC. The subpixel having the aforementioned configuration may be formed as a top-emission type subpixel, a bottom-emission type subpixel, or a dual-emission type subpixel.

The power supply part 125 converts external voltages supplied from the outside, and outputs a first potential voltage (e.g., around 20 V), a second potential voltage (e.g., around 3.3 V), a low potential voltage (e.g., around 0 V), etc. The first potential voltage is a drain-level voltage supplied to the first power supply line VDD, the second potential voltage is a collector-level voltage supplied to a second power supply line VCC, and the low potential voltage is a base-level voltage supplied to the ground line GND. The power supply part 125 is formed on the system board 110, along with the image processing part 120. Power output from the power supply part 125 is applied to the image processing part 120, the timing controller 130, the data driver 150, the scan driver 140, and the panel 160.

The aforementioned timing controller 130 transmits input pulses PLS1 to the panel 160, receives output pulses PLS2 fed back from the panel 160, and outputs a shutdown signal SDS for turning off the power supply part 125 according to a result of a comparison between the input pulses PLS1 and the output pulses PLS2.

The reason why the timing controller 130 outputs a shutdown signal SDS according to a result of the comparison between the input pulses PLS1 and the output pulses PLS2 is to turn off the power supply part 125 depending on whether or not a short circuit is present in the panel 160.

As the panel is driven by high current, when a short circuit occurs, overcurrent flows into the panel, and this generates high-temperature heat and burns the elements included in the subpixels of the panel 160, which may result in a fire.

A short circuit can occur in a variety of locations and parts during a manufacturing process (or module process), due to a variety of causes, including internal structural causes such as particles drawn into the panel 160, cracks, misalignment of pads, and narrow layout of lines, and external causes such as static electricity.

Accordingly, the timing controller controls the power supply part 125 to avoid this problem in advance and prevent the possibility of a fire in the panel 160 or the like. This will be described in detail below.

Hereinafter, an organic light emitting display in accordance with the present invention will be described in more detail.

<First Example Embodiment>

Figure 3:
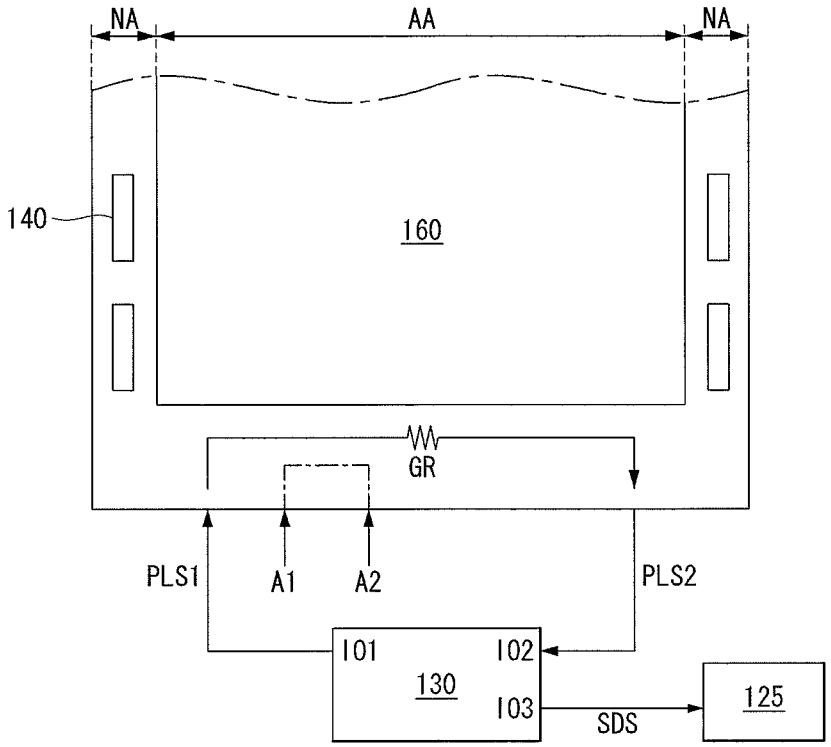
FIG. 3 is a view showing a configuration of a short circuit detector using a timing controller in accordance with a first example embodiment of the present invention.
Figure 4:
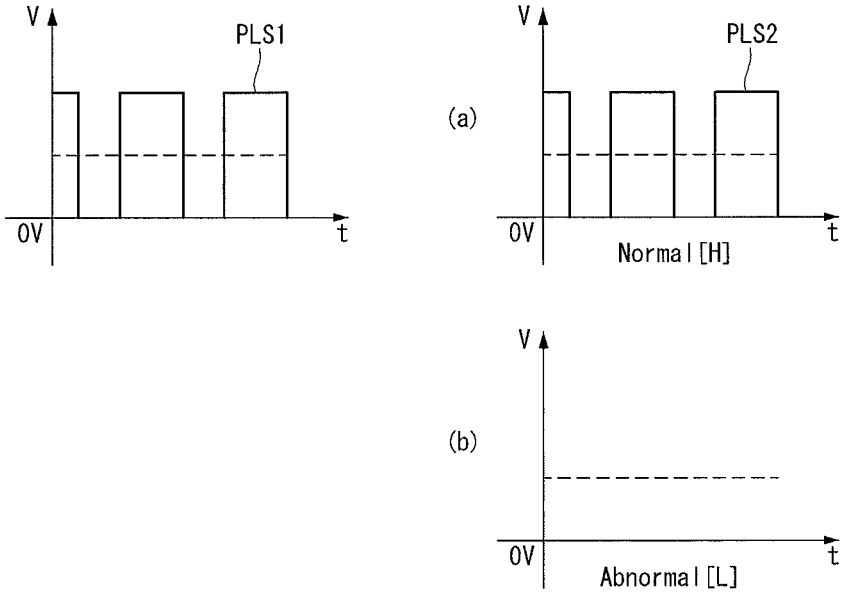
FIG. 4 is an illustration of input pulses and output pulses in accordance an embodiment of the present invention.
Figure 5:
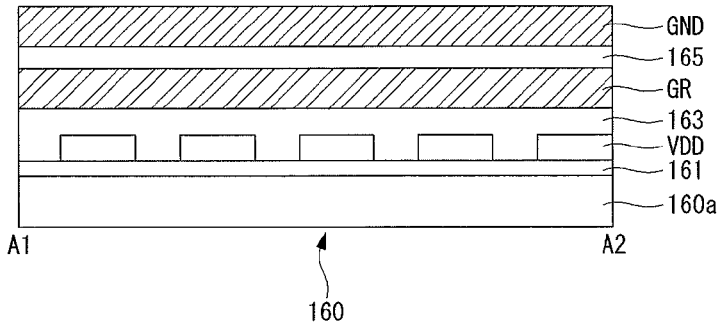
FIG. 5 is a cross-sectional view taken along line A1-A2 of FIG. 3 for a better understanding of a guide line in accordance an embodiment of the present invention.

FIG. 3 is a view showing a configuration of a short circuit detector using a timing controller in accordance with a first example embodiment of the present invention. FIG. 4 is an illustration of input pulses and output pulses in accordance with an embodiment of the present invention. FIG. 5 is a cross-sectional view taken along line A1-A2 of FIG. 3 for a better understanding of a guide line in accordance with an embodiment of the present invention.

As shown in FIGS. 3 and 5, a guide line GR is formed on the panel 160. A first terminal 101 of the timing controller 130 is connected to one end of the guide line GR, and a second terminal 102 thereof is connected to the other end of the guide line GR. That is, the timing controller 130 forms a kind of closed loop with the guide line GR formed on the panel 160. In embodiments of the present invention, a signal line may be used instead of the guideline so that the signal line and the guide line are separate lines. However, in other embodiments of the present invention the signal line and the guide line may refer to the same line.

The timing controller 130 transmits input pulses PLS1 output from the first terminal 101 through one end of the guide line GR, and receives output pulses PLS2 fed back through the other end of the guide line GR through the second terminal 102. The timing controller 130 controls the power supply part 125 according to a result of comparison between the input pulses PLS1 and the output pulses PLS2.

The input pulses PLS1 are formed to alternate between logic low and logic high, as shown in the left side of FIG. 4, for example. Accordingly, if the received output pulses PLS2 and the input pulses PLS1 have the same or similar shape, as shown in (a) of FIG. 4 at the right side, the timing controller 130 regards this as normal in which no short circuit is detected in the panel 160, and outputs no shutdown signal SDS through a third terminal IO3. Alternatively, if the received output pulses PLS2 and the input pulses PLS1 do not have the same or similar shape (or the signal corresponding to the output pulses is logic low), as shown in (b) of FIG. 4 at the right side, the timing controller 130 regards this as abnormal in which a short circuit is detected in the panel 160, and outputs a shutdown signal SDS through the third terminal IO3.

The aforementioned guide line GR is insulated between the first power supply line VDD and the ground line GND, as shown in FIG. 5. This will be described below in more detail.

A buffer layer 161 is formed on a first substrate 160*a*. The buffer layer 161 is formed to protect devices, such as thin film transistors, to be formed in a subsequent process from impurities such as alkali ions leaking from the first substrate 160*a*.

A first power supply line VDD is formed on the buffer layer 161. The first power supply line VDD is a line for supplying a first potential voltage to the subpixels. The first power supply line VDD is divided into a plurality of lines and extends in the same direction as the data lines, as shown in the drawing.

A first insulating film 163 is formed on the first power supply line VDD. The first insulating film 163 may be a silicon oxide (SiOx) film or a silicon nitride (SiNx) film. The first insulating film 163 may be a gate insulating film for thin film transistors.

A guide line GR is formed on the first insulating film 163. A second insulating film 165 is formed on the guide line GR, and a second power supply line GND is formed on the second insulating film 165.

The guide line GR is selectively formed in some parts of a non-active area NA of the panel 160, some parts of an active area AA thereof, or some or parts of both the non-active area NA and active area AA thereof. In the instance that the guide line GR is formed in the non-active area NA of the panel 160, the timing controller 130 can detect whether or not there has occurred a short circuit in the non-active area NA. Alternatively, in the instance that the guide line GR is formed in the active area AA of the panel 160, the timing controller can detect whether or not a short circuit has occurred in the active area AA. Alternatively, in the instance that the guide line GR is formed in both of the non-active area NA and active area AA of the panel 160, the timing controller 130 can detect whether or not a short circuit has occurred in both of the non-active area NA and active area AA.

Hereinafter, the configuration of a short circuit detector will be described.

Figure 6:
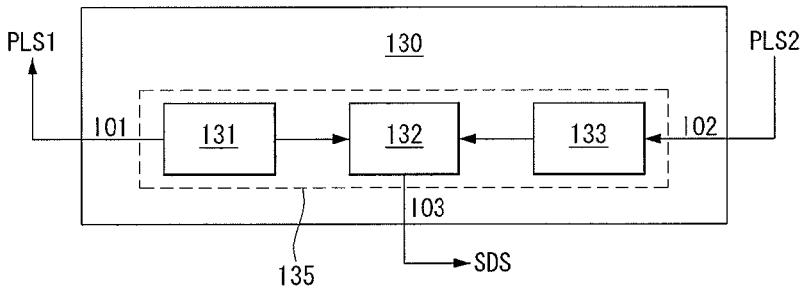
FIG. 6 is a block diagram of a short circuit detector included in a timing controller in accordance an embodiment of the present invention.

FIG. 6 is a block diagram of a short circuit detector included in a timing controller in accordance with an embodiment of the present invention.

As shown in FIG. 6, the timing controller 130 comprises a short circuit detector 135 comprising a pulse generator 131, a pulse comparator 133, and a shutdown signal generator 132. The short circuit detector 135 is divided into the pulse generator 131, the pulse comparator 133, and the shutdown signal generator 132 only to facilitate functional explanation, and one or more of these components may be integrated together.

The pulse generator 131 generates input pulses PLS1, and outputs the generated input pulses PLS1 through the first terminal 101 of the timing controller 130. The pulse generator 131 generates input pulses PLS1 in such a way as to alternate between logic low and logic high, as shown in the left side of FIG. 4. However, even if the input pulses PLS1 are transmitted as shown in the left side of FIG. 4, the received output pulses PLS2 and the input pulses PLS1 do not have the same shape (including not receiving desired output pulses). This is because each panel has its own signal delay values for various causes such as parasitic capacitance and parasitic resistance. Since each panel has its own signal delay values, the pulse generator 131 determines whether or not a short circuit is present in the panel, depending on whether the input pulses PLS1 and the output pulses PLS2 have the same or similar phase. In this instance, the pulse generator 131 may generate the input pulses in such a way as to alternate between logic low and logic high, or may vary one or more of the width and period of the signal and even detect the signal when it is received. Therefore, the pulse generator 131 can generate input pulses PLS1 by using various signals, such as the data enable signal DE, clock signal CLK, etc., from the timing controller 130, thereby increasing the degree of freedom of design and ensuring detectability.

The pulse comparator 133 compares the input pulses PLS1 and the output pulses PLS2. The pulse comparator 133 receives the output pulses PLS2 through the second terminal 102 of the timing controller 130. For example, the pulse comparator 133 may comprise a phase comparator.

The pulse comparator 133 compares the input pulses PLS1 and the output pulses PLS2, and if the input pulses PLS1 and the output pulses PLS2 have the same or similar shape, outputs a logic low (or logic high) signal. On the other hand, if the input pulses PLS1 and the output pulses PLS2 do not have the same or similar shape (or there is no signal corresponding to the output pulses), the pulse comparator 133 outputs a logic high (or logic low) signal.

The shutdown signal generator 132 outputs a shutdown signal SDS through the third terminal IO3 of the timing controller 130. When a logic low signal is supplied from the pulse comparator 133 according to a result of comparison between the input pulses PLS1 and the output pulses PLS2, the shutdown signal generator 132 outputs a shutdown signal SDS for the logic low signal or not. On the other hand, when a logic high signal is supplied from the pulse comparator 133 according to a result of comparison between the input pulses PLS1 and the output pulses PLS2, the shutdown signal generator 132 outputs a shutdown signal SDS for the logic high signal.

The embodiments of the present invention have been described with respect to an example in which the short circuit detector 135 comprising the pulse generator 131, the pulse comparator 133, and the shutdown signal generator 132 is included in the timing controller 130. Alternatively, the short circuit detector 135 may be configured separately from the timing controller 130. In this instance, the short circuit detector 135 may be configured to receive only a pulse signal corresponding to the input pulses PLS1 from the timing controller 130, or to use the data enable signal DE or clock signal CLK output from the image processing part 120 as the input pulses PLS1.

Meanwhile, if the short circuit detector 135 is included in the timing controller 130, the timing controller 130 may be damaged by a short circuit, or weak signals may be produced.

An example for solving this problem will be given as follows. FIG. 6 will be referred to for convenience of description.

<Second Example Embodiment>

Figure 7:
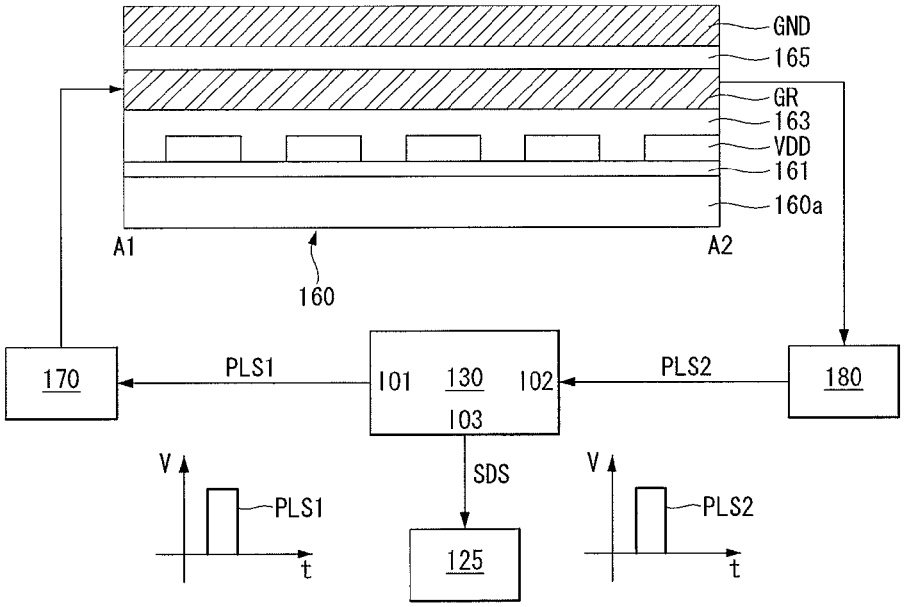
FIGS. 7 to 9 are views for explaining an example of short circuit detection using a pulse transmitter and a pulse receiver that operates in connection with a timing controller in accordance with a second example embodiment of the present invention.
Figure 8:
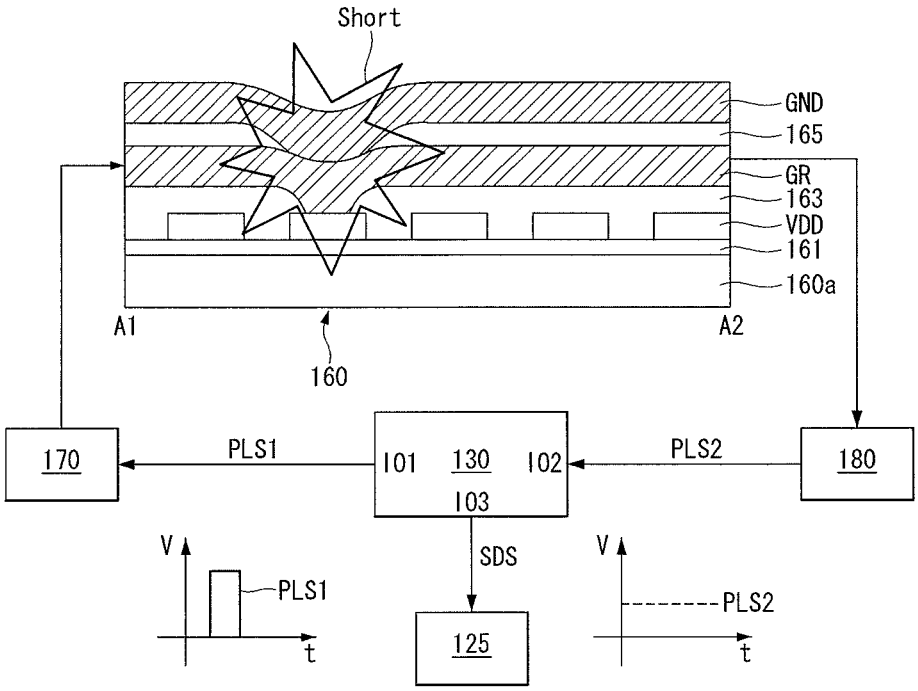
Figure 9:
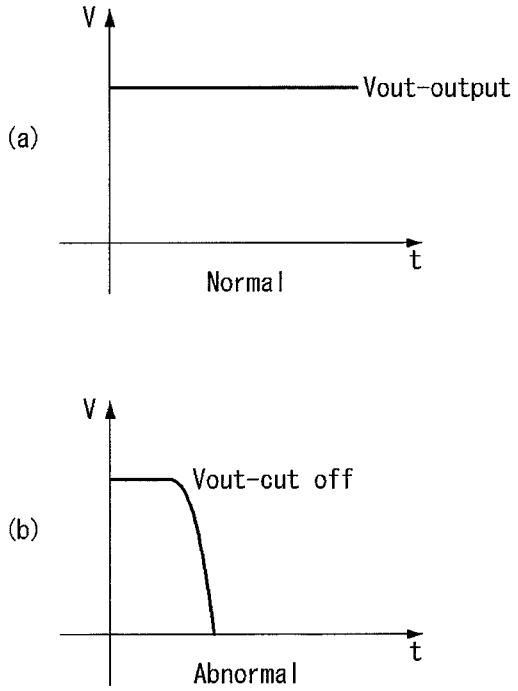

FIGS. 7 to 9 are views for explaining an example of short circuit detection using a pulse transmitter and a pulse receiver that operates in connection with the timing controller in accordance with a second example embodiment of the present invention.

As shown in FIGS. 6, 7, and 9, a pulse transmitter 170 and a pulse receiver 180 are respectively connected to the first terminal 101 and second terminal 102 of the timing controller 130.

The pulse transmitter 170 serves as a pulse transmission buffer that receives input pulses PLS1 from the pulse generator 131 and transmits the input pulses PLS1 through one end of the guide line GR. The pulse receiver 180 serves as a pulse reception buffer that receives output pulses PLS2 fed back through the other end of the guide line GR and provides them to the pulse comparator 133.

As shown in FIG. 7, if there is no factor causing a short circuit in the panel 160, the input pulses PLS1 and the output pulses PLS2 are received in the same or similar shape. Accordingly, the shutdown signal generator 132 outputs no shutdown signal SDS through the third terminal IO3. At this time, the power supply part maintains the output from the output end Vout, as shown in (a) of FIG. 9 [Normal].

As shown in FIG. 8, if there is a factor causing short circuit in the panel 160, there is no signal corresponding to the output pulses PLS2 (or the input pulse and the output pulse do not have the same or similar shape). Accordingly, the shutdown signal generator 132 outputs a shutdown signal SDS through the third terminal IO3 of the timing controller 130. At this time, the power supply part cuts off the output from the output end Vout, as shown in (b) of FIG. 9 [Abnormal].

Hereinafter, an example of the circuit configuration of the aforementioned pulse transmitter 170 and pulse receiver 180 will be described.

<Third Example Embodiment>

Figure 10:
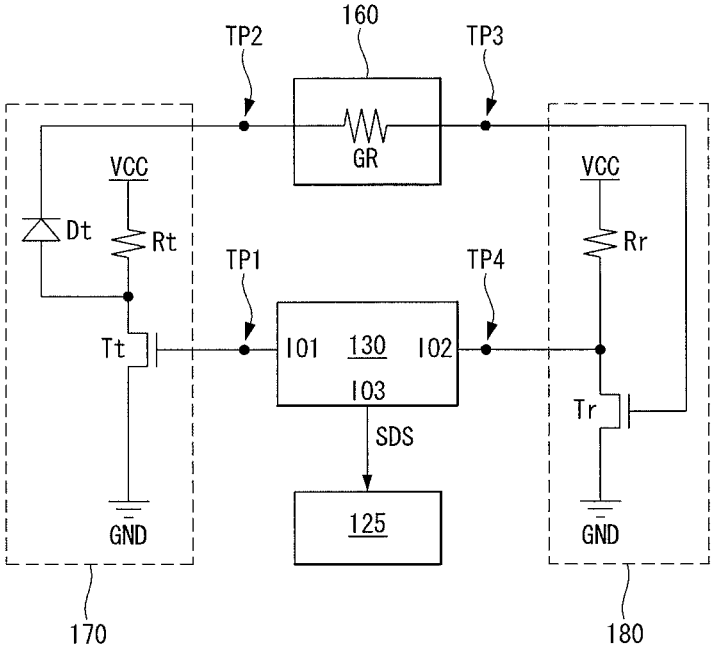
FIG. 10 is an illustration of a circuit configuration of a pulse transmitter and a pulse receiver that operates in connection with a timing controller in accordance with a third example embodiment of the present invention.
Figure 11:
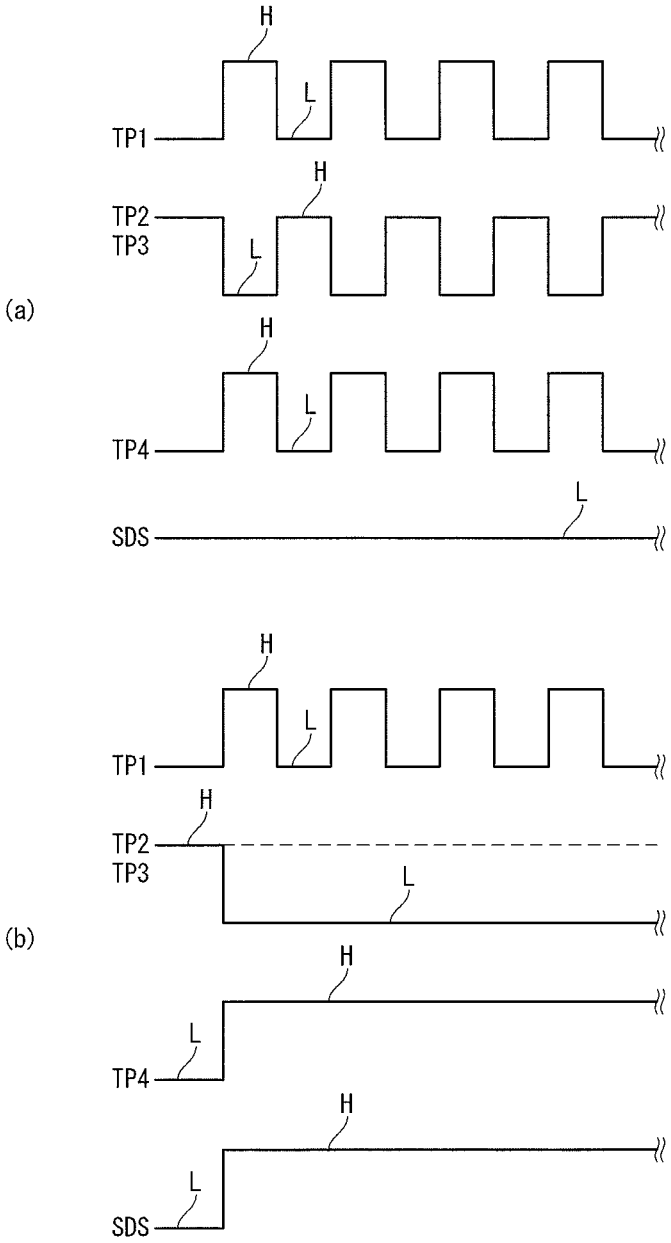
FIG. 11 is a waveform diagram for explaining an operation corresponding to a circuit configuration of FIG. 10 in accordance an embodiment of the present invention.

FIG. 10 is an illustration of a circuit configuration of a pulse transmitter and a pulse receiver that operates in connection with a timing controller in accordance with a third example embodiment of the present invention. FIG. 11 is a waveform diagram for explaining an operation corresponding to the circuit configuration of FIG. 10 in accordance with an embodiment of the present invention.

As shown in FIGS. 6 and 10, the pulse transmitter 170 comprises a first resistor Rt and a first transistor Tt. The pulse transmitter 170 serves to transmit the input pulses PLS1 output from the pulse generator 131 connected to the first terminal 101 of the timing controller 130 to the guide line GR.

To this end, one end of the first resistor Rt is connected to the second power supply line VCC, and the other end thereof is connected to one end of the guide line GR. A first electrode of the first transistor Tt is connected to the other end of the first resistor Rt, a second electrode thereof is connected to the ground line GND, and a gate electrode thereof is connected to the first terminal 101 of the pulse generator 131.

The pulse transmitter 170 comprises a diode Dt interposed between the other end of the first resistor Rt and one end of the guide line GR. The diode Dt prevents the first potential voltage flowing through the first power supply line from flowing backward when there is a short circuit between the first power supply line and the guide line. To this end, an anode of the diode Dt is connected to the other end of the first resistor Rt, and a cathode thereof is connected to one end of the guide line GR.

The pulse receiver 180 comprises a second resistor Rr and a second transistor Tr. The pulse receiver 180 serves to supply the output pulses PLS2 fed back through the guide line GR to the pulse comparator 133 included in the timing controller 130.

To this end, one end of the second resistor Rr is connected to the second power supply line VCC, and the other end thereof is connected to the second terminal 102 of the pulse comparator 133. A first electrode of the second transistor Tr is connected to the other end of the second resistor Rr, a second electrode thereof is connected to the ground line GND, and a gate electrode thereof is connected to the other end of the guide line GR.

Since the guide line GR and the timing controller 130 are indirectly and electrically connected to each other by means of the aforementioned pulse transmitter 170 and pulse receiver 180, this prevents circuit damage to the timing controller 130 even when a short circuit occurs between power sources. The foregoing description has been made as an example in which one end of both the first and second resistors Rt and Rr is connected to the second power supply line VCC. Alternatively, one end of both the first and second resistors Rt and Rr may be connected to another power supply line that supplies a high potential voltage.

With the pulse transmitter 170 and the pulse receiver 180 having the above circuit configuration, the following waveforms are detected at test points TP1 to TP4 depending on panel conditions.

(a) of FIG. 11 depicts the waveforms detected at the test points TP1 to TP4 under the normal condition where no short circuit is present in the panel 160.

As shown in FIG. 6, FIG. 10, and (a) of FIG. 11, when input pulses PLS1 alternating between logic high H and logic low L are output through the first terminal 101 of the timing controller 130, the same pulses as the input pulses PLS1 are detected at the first test point TP1.

When the input pulses PLS1 are logic high H, the first transistor Tt is turned on. On the other hand, if the input pulses PLS1 are logic low L, the first transistor Tt is turned off. As the panel 160 is in the normal condition with no short circuit, input pulses PLS1 of logic low L and logic high H having a reverse phase to those of the first test point TP are detected at the second test point TP2, and the same output pulses PLS2 as the second test point TP2 are detected at the third test point TP3.

When the output pulses PLS2 are logic low L, the second transistor Tr is turned off. On the other hand, if the output pulses PLS2 are logic high H, the second transistor Tr is turned on. Accordingly, output pulses PLS2 of logic high H and logic low L having a reverse phase to those of the third test point TP3 are detected at the fourth test point TP4.

In this instance, output pulses PLS2 having the same or similar phase to that of the input pulses PLS1 are supplied to the second terminal 102 of the timing controller 130. When the input pulses PLS1 and the output pulses PLS2 have the same or similar phase, this is regarded as normal in which no short circuit is detected in the panel 160. Therefore, the timing controller 130 outputs a shutdown signal SDS of logic low L through the third terminal IO3, and the power supply part maintains its output.

(b) of FIG. 11 depicts the waveforms detected at the test points TP1 to TP4 under the abnormal condition where a short circuit is present in the panel 160.

As shown in FIG. 6, FIG. 10, and (b) of FIG. 11, when input pulses PLS1 alternating between logic high H and logic low L are output through the first terminal 101 of the timing controller 130, the same pulses as the input pulses PLS1 are detected at the first test point TP1.

When the input pulses PLS1 are logic high H, the first transistor Tt is turned on. On the other hand, if the input pulses PLS1 are logic low L, the first transistor Tt is turned off. As the panel 160 is in the abnormal condition with a short circuit, input pulses PLS1 of logic low L are continuously detected at the second test point TP2, and the same output pulses PLS2 of logic low L as the second test point TP2 are detected at the third test point TP3.

When the output pulses PLS2 are continuously logic low L, the second transistor Tr is kept turned off. Accordingly, output pulses PLS2 of logic high H having a reverse phase to that of the third test point TP3 are continuously detected at the fourth test point TP4.

In this instance, output pulses PLS2 having a different phase and pulse width from those of the input pulses PLS1 are supplied to the second terminal 102 of the timing controller 130. When the input pulses PLS1 and the output pulses PLS2 are different, this is regarded as abnormal in which a short circuit is detected in the panel 160. Therefore, the timing controller 130 outputs a shutdown signal SDS of logic high H through the third terminal IO3, and the power supply part cuts off its output.

Hereinafter, an example of an organic light emitting display configured in accordance with the present invention will be described.

Figure 12:
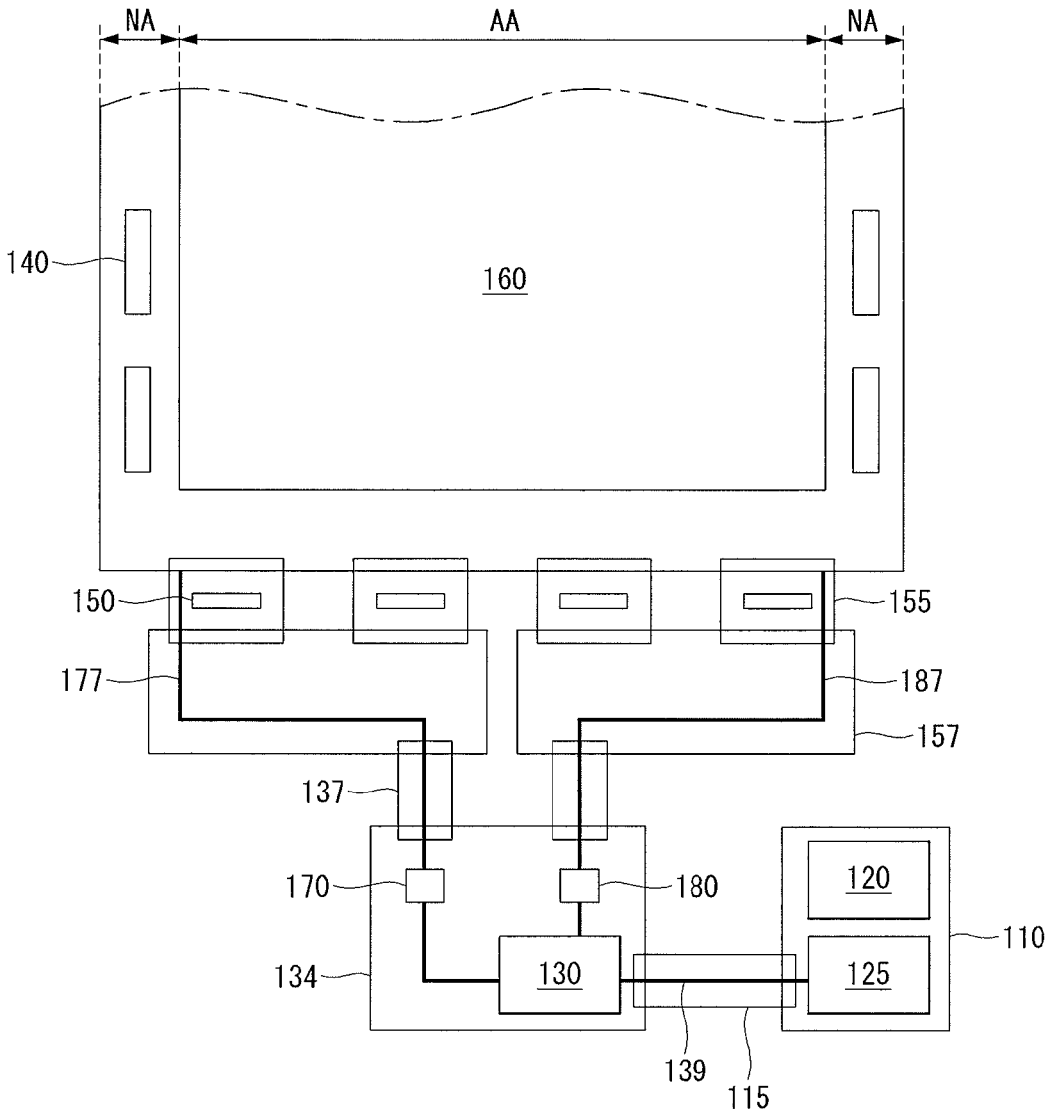
FIG. 12 is a first illustration of an organic light emitting display configured using components in accordance an embodiment of the present invention.
Figure 13:
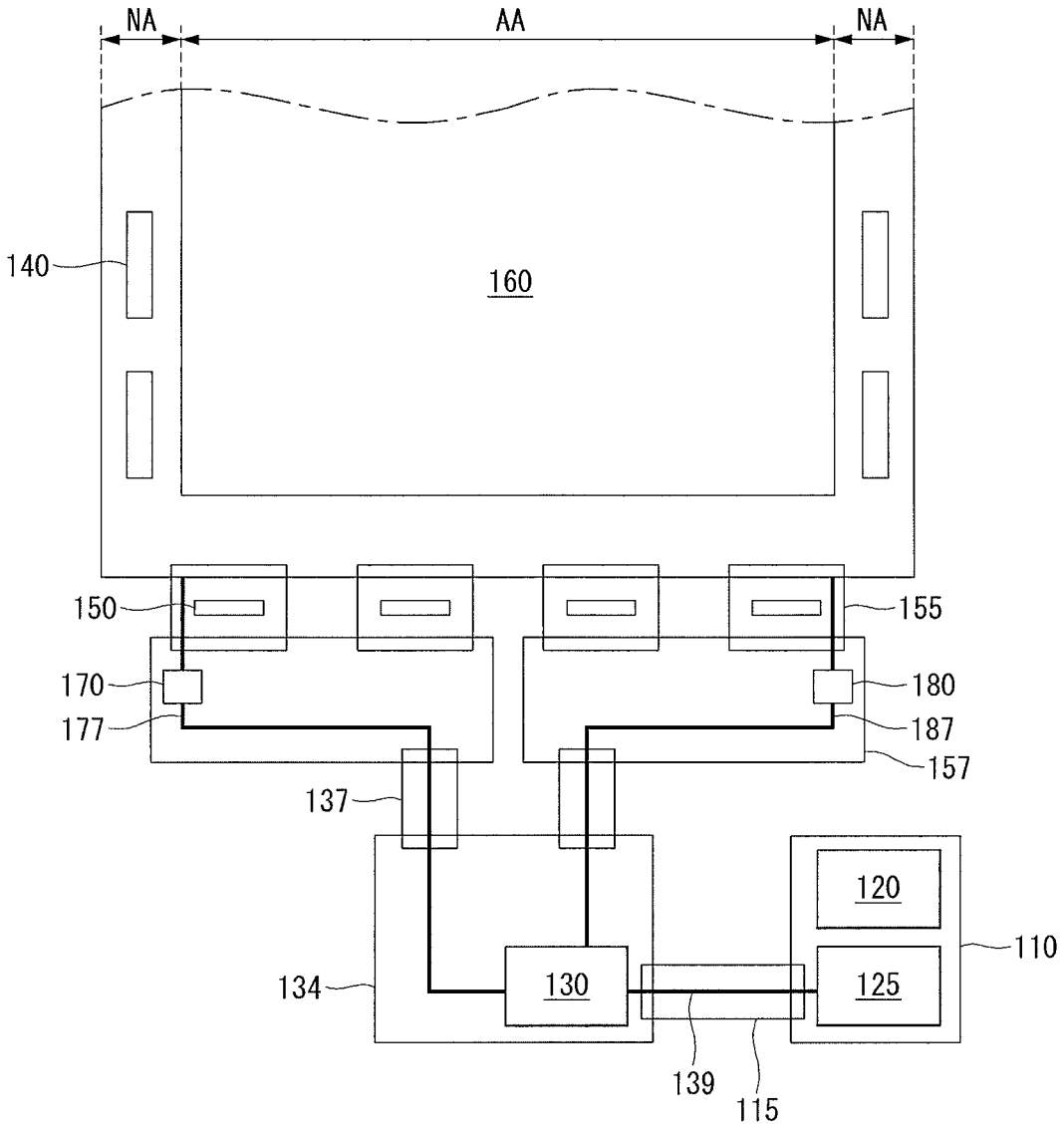
FIG. 13 is a second illustration of an organic light emitting display configured using components in accordance an embodiment of the present invention.

FIG. 12 is a first illustration of an organic light emitting display configured using components in accordance with an embodiment of the present invention. FIG. 13 is a second illustration of an organic light emitting display configured using components in accordance with an embodiment of the present invention.

As shown in FIG. 12, a plurality of scan drivers 140 are formed in the non-active area NA on both outer sides of the active area AA of the panel 160. The scan drivers 140 are formed on the panel 160 in a gate-in panel type, along with a subpixel transistor process. A data driver 150 is configured as a plurality of (e.g., four) ICs (Integrated Circuits), and mounted on a plurality of (e.g., four) first flexible substrates 155. One end of the data driver 150 is attached to pads of the panel 160, and the other end of the data driver 150 is attached to a plurality of (e.g., two) source circuit boards 157.

The timing controller 130, the pulse transmitter 170, and the pulse receiver 180 are formed on a control circuit board 134. The source circuit boards 157 and the control circuit board 134 are connected by second flexible substrates 137. The image processing part 120 and the power supply part 125 are formed on the system board 110. The control circuit board 134 and the system board 110 are connected by a third flexible substrate 115.

With the organic light emitting display having the above structure, the first potential voltage output from the power supply part 125 is supplied via a first power supply line extending to the panel 160 through the control circuit board 134.

The pulse transmitter 170 is connected to one end of the guide line formed on the panel 160 via a pulse transmission line 177 extending to the first flexible substrate 155 through the control circuit board 134, the second flexible substrate 137, and the source circuit board 157. The pulse receiver 180 is connected to the other end of the guide line formed on the panel 160 via a pulse reception line 187 extending to the first flexible substrate 155 through the control circuit board 134, the second flexible substrate 137, and the source circuit board 157. The timing controller 130 is connected to the power supply part 125 via a shutdown signal line 139 extending to the system board 110 through the control circuit board 134 and the third flexible substrate 115.

FIG. 12 is illustrated by an example in which the pulse transmitter 170 and the pulse receiver 180 are formed on the control circuit board 134. Alternatively, the pulse transmitter 170 and the pulse receiver 180 may be formed on the source circuit boards 157, as shown in FIG. 13. Otherwise, the present invention may be modified in such a manner that the pulse transmitter 170 is formed on the control circuit board 134 and the pulse receiver 180 is formed on the source circuit board 157.

While the foregoing description has been made with respect to an example in which a variety of substrates and boards, from the system board 110 to the panel 160, are included as the components required to establish an electrical connection, some of the substrates and boards may be integrated together for simple configuration.

The pulse transmission line 177 and the pulse reception line 187 are connected to the panel 160 by an electrical connection method using pads. Accordingly, the present invention makes it possible to detect problems involving misalignment of the pads (open pads) or a short circuit of the pads, which occur when the pads formed on the panel 160 and the pads formed on the first flexible substrates 155 are attached together. This will be described below.

Figure 14:
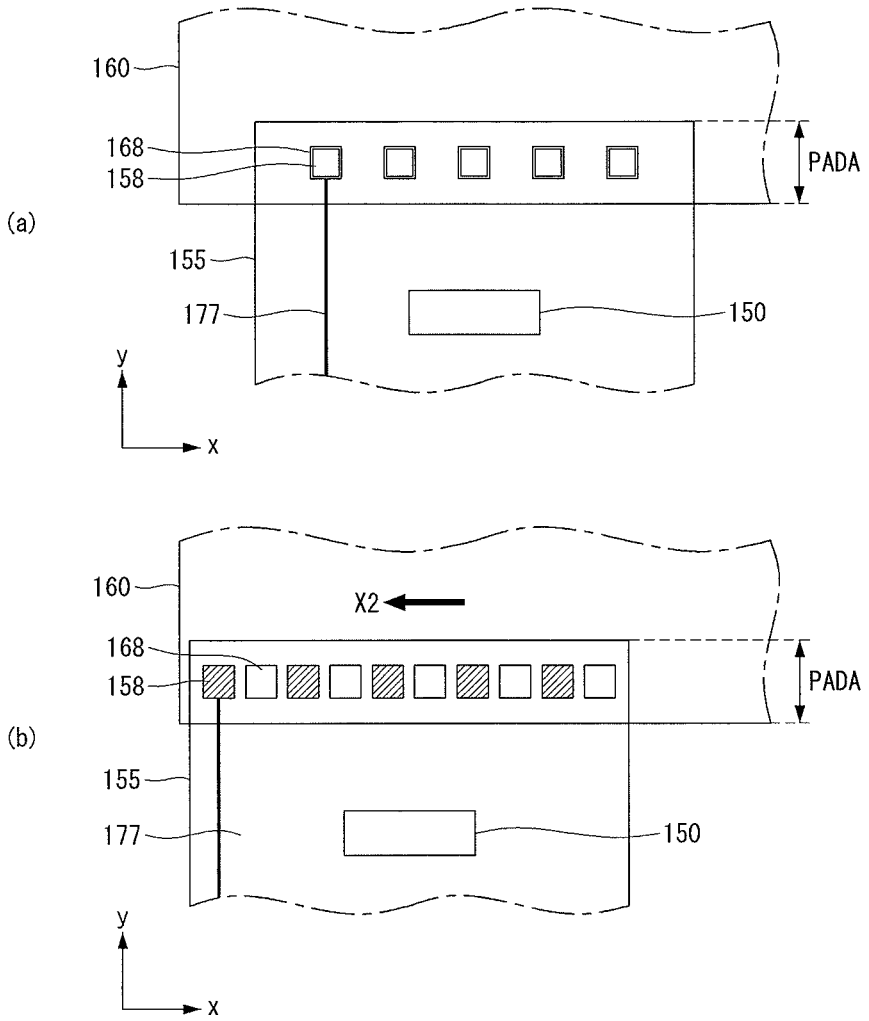
FIG. 14 is a view for explaining a method for detecting a problem of pad misalignment occurring when pads are attached in accordance with a configuration in accordance an embodiment of the present invention.

FIG. 14 is a view for explaining a method for detecting a problem of pad misalignment occurring when pads are attached in accordance with a configuration in accordance with an embodiment of the present invention.

As shown in FIGS. 12 and 14, first pads 168 are formed in a pad area PADA of the panel 160. Subpixels included in the panel 160, a guide line, a first power supply line, a ground line, and lines for transmitting signals or power to the scan driver 140 are connected to the first pads 168. Second pads 158 to be connected to the first pads 168 are formed on the first flexible substrate 155 where the data driver 150 is mounted.

The first pads 168 and the second pads 158 are aligned with each other in the pad area PADA, and electrically connected to each other by an anisotropic conductive film (ACF). When the first pads 168 and the second pads 158 are attached in an accurate aligned position, the first pads 168 and the second pads 158 correspond to each other, as shown in (a) of FIG. 14. On the other hand, when the first pads 168 and the second pads 158 are attached in an inaccurate aligned position, the first pads 168 and the second pads 158 are separated from each other. For example, the first pads 168 and the second pads 158 do not overlap each other.

As shown in (a) of FIG. 14, when the first pads 168 and the second pads 158 are attached in an accurate aligned position, the pulse transmission line 177 formed on the first flexible substrate 155 can properly supply input pulses to the guide line formed on the panel 160. Accordingly, the timing controller 130 receives normal output pulses as long as there is no short circuit in the panel 160.

As shown in (b) of FIG. 14, when the first pads 168 and the second pads 158 are attached in an inaccurate aligned position (pad misalignment occurs), the pulse transmission line 177 formed on the first flexible substrate 155 cannot properly supply input pulses to the guide line formed on the panel 160. Accordingly, the timing controller 130 receives abnormal output pulses regardless of whether or not there is a short circuit in the panel 160. For example, the timing controller 130 receives no signal or logic low output pulses, as shown in the right side (b) of FIG. 4.

In (a) of FIG. 14, the timing controller 130 does not output a shutdown signal for turning off the power supply part through the shutdown signal line 139, if there is no short circuit in the panel 160. On the other hand, in (b) of FIG. 14, even if there is no short circuit in the panel 160, the timing controller 130 outputs a shutdown signal for turning off the power supply part through the shutdown signal line 139 because pad misalignment has occurred even if there is no short circuit in the panel 160. By doing so, it is possible to know whether the aligned state of the pads is normal or abnormal, even when no additional process is conducted in an FOG process for electrically connecting the first pads 168 and the second pads 158.

The present invention has been described only with reference to the misalignment of the first pads 168 formed on the panel 160 and the second pads 158 formed on the first flexible substrate 155. However, the embodiment of the present invention is not limited thereto, but also covers pad misalignment that occurs in at least either one of the control circuit board 134, the second flexible substrates 137, the source circuit boards 157, and the first flexible substrates 155, because the pulse transmission line 177 and the pulse reception line 187 extend to the first flexible substrates 155 through the control circuit board 134, the second flexible substrates 137, and the source circuit boards 157. That is, it is possible to detect a short circuit or open pads, which occurs during the entire module process by using the components in accordance with an example embodiment of the present invention.

Hereinafter, a method for driving an organic light emitting display in accordance with the present invention will be described.

Figure 15:
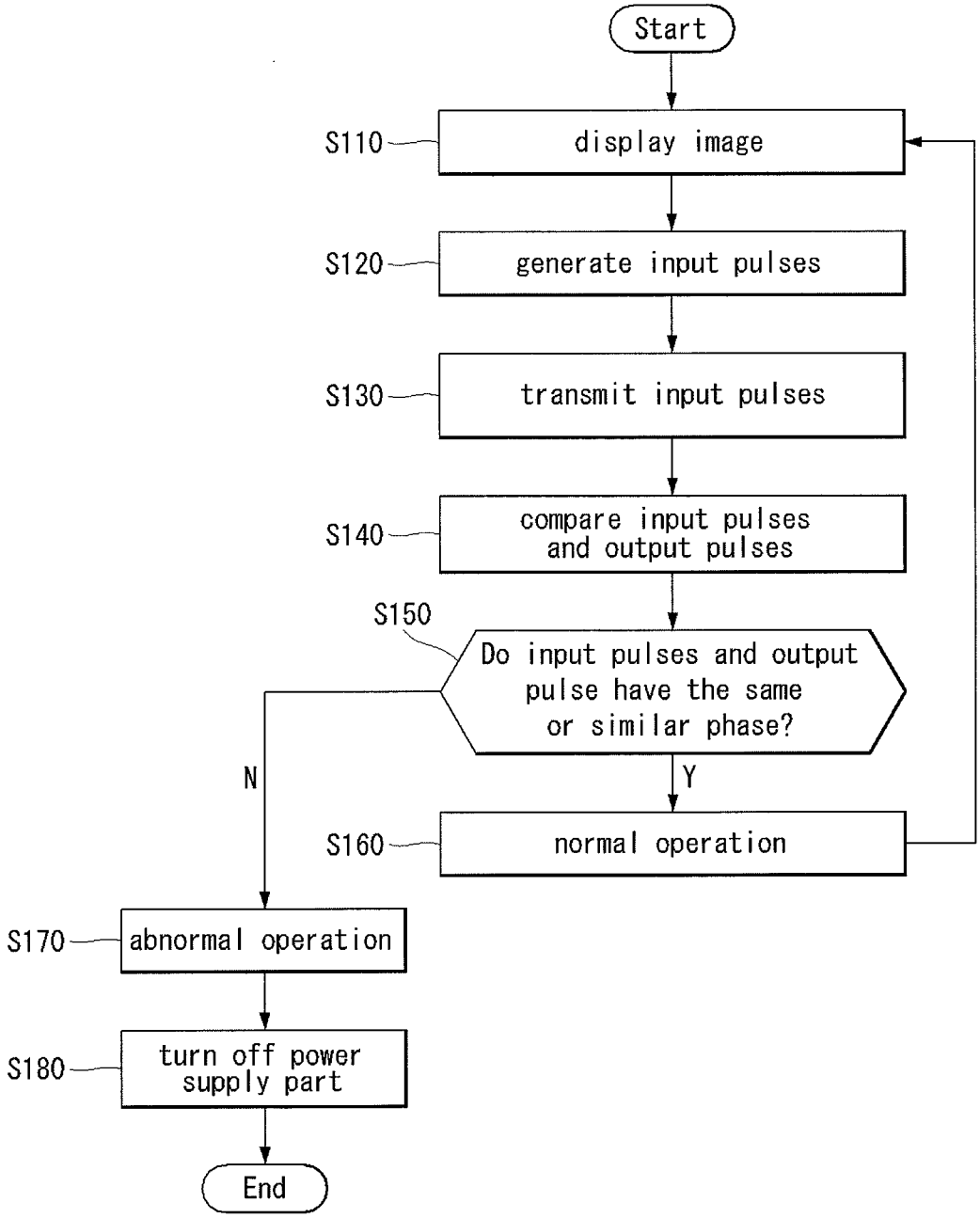
FIG. 15 is a flowchart for explaining a method for driving an organic light emitting display in accordance with a fourth example embodiment of the present invention.

FIG. 15 is a flowchart for explaining a method for driving an organic light emitting display in accordance with a fourth example embodiment of the present invention. The driving method of FIG. 15 merely represents a method using one or more of the aforementioned components, but is not limited thereto. For better understanding of the description, reference will be made to FIGS. 1 through 14.

First, an image is displayed on the panel 160 (5110). Next, input pulses PLS1 are generated to be supplied to the signal line and/or the guide line GR formed on the panel 160 (S120). Next, the input pulses PLS1 are transmitted through one end of the signal line and/or the guide line GR, and feedback output pulses PLS2 are received through the other end of the guide line GR (S130). Next, the input pulses PLS1 and the output pulses PLS2 are compared with each other (S140).

In embodiments of the invention, the method further includes one or more of the following operations. Next, it is determined whether the input pulses PLS1 and the output pulses PLS2 have the same or similar phase (S150). If the input pulses PLS1 and the output pulses PLS2 have the same or similar phase (Y), this is regarded as a normal operation (S160), and a shutdown signal SDS for turning off the power supply part 125 that supplies power to the panel 160 is not output. On the contrary, if the input pulses PLS1 and the output pulses PLS2 do not have the same or similar phase (N), this is regarded as an abnormal operation (S170), a shutdown signal SDS for turning off the power supply part 125 that supplies power to the panel 160 is output (S180).

When the input pulses PLS1 are transmitted through one end of the signal line and/or the guide line GR, and feedback output pulses PLS2 are received through the other end of the guide line GR, the transmission of the input pulses PLS1 may occur between frames of the image that is displayed on the panel 160. In other embodiments of the invention, the transmission of the input pulses PLS1 may occur at an intermediate point in time when the image is displayed on the panel 160.

In embodiment of the present invention, the short circuit detector transmits the input pulses and receives the output pulses for a comparison during a normal operation of the organic light emitting display. The normal operation of the organic light emitting display includes a period between the organic light emitting display being turned on and turned off. The period includes when the organic light emitting display is not displaying an image. Also, in another embodiment of the present invention, the short circuit detector transmits the input pulses and receives the output pulses for the comparison during the period when the organic light emitting display is not displaying the image.

In the generation of input pulses PLS1 set forth in the above description, the input pulses PLS1 may be generated in such a way as to alternate between logic low L and logic high H, as shown in the left side of FIG. 4. In the present invention, it is determined whether or not there is a short circuit in the panel 160, based on whether the input pulses PLS1 and the output pulses PLS2 have the same or similar shape. Accordingly, one or more of the level, width, and period of the signal may be varied as long as the input pulses PLS1 alternate between logic low L and logic high H or between logic high H and logic low L.

As seen from above, the present invention provides an organic light emitting display, which, in the event of a short circuit, prevents local burning from spreading over the entire surface as overcurrent flows through the elements included in the subpixels, and therefore eliminates the possibility of a fire, and a method for driving the same. Moreover, the present invention provides an organic light emitting display, which is capable of detecting open pads as well as a short circuit in the panel, and a method for driving the same.

What is claimed is:

1. An organic light emitting display comprising:

a panel;

a guide line disposed on the panel, and insulated between a first power supply line and a ground line;

drivers configured to drive the panel; and a timing controller that controls operation timing of the drivers using timing signals, wherein the timing controller further forms a closed loop with a signal line of the panel, transmits input pulses through one end of the signal line and receives output pulses fed back through the other end of the signal line, and compares the input pulses and the output pulses, wherein the signal line is selectively formed in portions of a non-active area of the panel, portions of an active area of the panel, or portions of both the non-active area and the active area, and wherein the timing controller outputs a shutdown signal for turning off a power supply part according to a predetermined result of the comparison between the input pulses and the output pulses.

2. The organic light emitting display of claim 1, wherein the timing controller transmits the input pulses and receives the output pulses for the comparison during normal operation of the organic light emitting display.

3. The organic light emitting display of claim 2, wherein the normal operation of the organic light emitting display includes a period between the organic light emitting display being turned on and turned off.

4. The organic light emitting display of claim 3, wherein the period includes when the organic light emitting display is not displaying an image.

5. The organic light emitting display of claim 4, wherein the timing controller transmits the input pulses and receives the output pulses for the comparison during the period when the organic light emitting display is not displaying the image.

6. The organic light emitting display of claim 1, wherein the timing controller generates the input pulses to alternate between logic low and logic high.

7. The organic light emitting display of claim 1, wherein, when the input pulses and the output pulses have different phases, the timing controller outputs the shutdown signal.

8. The organic light emitting display of claim 1, wherein the timing controller includes a short circuit detector, and the short circuit detector comprises:

a pulse generator configured to generate the input pulses;

a pulse comparator configured to compare the input pulses and the output pulses; and a shutdown signal generator configured to output the shutdown signal according to the result of the comparison between the input pulses and the output pulses.

9. The organic light emitting display of claim 8, wherein the short circuit detector further comprises:

a pulse transmitter that receives the input pulses from the pulse generator and transmits the input pulses through the one end of the signal line; and a pulse receiver that receives the output pulses output through the other end of the signal line and supplies the output pulses to the pulse comparator.

10. The organic light emitting display of claim 9, wherein the pulse transmitter comprises:

a first resistor, one end of which is connected to a second power supply line, and the other end of which is connected to one end of a guide line; and a first transistor, a first electrode of which is connected to the other end of the first resistor, a second electrode of which is connected to a ground line, and a gate electrode of which is connected to a terminal of the pulse generator, and wherein the pulse receiver comprises:

a second resistor, one end of which is connected to the second power supply line, and the other end of which is connected to a terminal of the pulse comparator; and a second transistor, a first electrode of which is connected to the other end of the second resistor, a second electrode of which is connected to the ground line, and a gate electrode of which is connected to the other end of the signal line.

11. The organic light emitting display of claim 10, wherein the pulse transmitter comprises a diode interposed between the other end of the first resistor and the one end of the signal line, and wherein an anode of the diode is connected to the other end of the first resistor, and a cathode thereof is connected to the one end of the signal line.

12. The organic light emitting display of claim 9, wherein the pulse transmitter and the pulse receiver are formed on a source circuit board connected to the panel or on a control circuit board where the timing controller is formed.

13. The organic light emitting display of claim 1, wherein the signal line is insulated between the first power supply line and the ground line which are formed on a first substrate constituting the panel.

14. The organic light emitting display of claim 13, comprising:

a buffer layer formed on the first substrate;

the first power supply line formed on the buffer layer;

a first insulating film formed on the first power supply line;

the signal line formed on the first insulating film;

a second insulating film formed on the signal line; and the ground line formed on the second insulating film.

15. A method for driving an organic light emitting display, the method comprising:

displaying an image on a panel;

generating input pulses to be supplied to a signal line of the panel;

transmitting the input pulses through one end of the signal line and receiving output pulses fed back through the other end of the signal line;

comparing the input pulses and the output pulses; and outputting a shutdown signal for turning off a power supply part of the light emitting display according to a result of the comparison between the input pulses and the output pulses, wherein the signal line is selectively formed in portions of a non-active area of the panel, portions of an active area of the panel, or portions of both the non-active area and the active area, and wherein the generating of the input pulses, the receiving of the output pulses, and the outputting of the shutdown signal are performed by a timing controller that controls operation timing of drivers using timing signals, the timing controller forming a closed loop with the signal line.

16. The method of claim 15, wherein, when the input pulses and the output pulses have different phases or when the output pulses are not received, the shutdown signal is output.

* * * * *